United States Patent [19]

Wedel

[11] Patent Number: 4,815,220

[45] Date of Patent: Mar. 28, 1989

[54] WEB TRANSFER APPARATUS

[75] Inventor: Gregory L. Wedel, Beloit, Wis.

[73] Assignee: Beloit Corporation, Beloit, Wis.

[21] Appl. No.: 888,021

[22] Filed: Jul. 18, 1986

[51] Int. Cl.[4] ..... F26B 9/04

[52] U.S. Cl. ..... 34/120; 34/113; 34/116; 34/117

[58] Field of Search ..... 34/114, 116, 117, 120, 34/122, 123

[56] References Cited

U.S. PATENT DOCUMENTS

| | | | |
|---|---|---|---|
| 3,250,019 | 5/1966 | Beachler | 34/117 |
| 3,753,298 | 8/1973 | Ely | 34/117 |
| 3,868,780 | 3/1975 | Soininen et al. | 34/116 |
| 4,000,035 | 12/1976 | Schiel | 34/117 |
| 4,477,983 | 10/1984 | Andersson | 34/116 |
| 4,483,083 | 11/1984 | Chance | 34/116 |
| 4,513,517 | 4/1985 | Vedenpaa | 34/117 |
| 4,551,203 | 11/1985 | Eskelinen | 34/114 |
| 4,566,946 | 1/1986 | Koponen et al. | 34/114 |
| 4,610,097 | 9/1986 | Kotitschke et al. | 34/120 |
| 4,648,942 | 3/1987 | Wanke et al. | 34/117 |

*Primary Examiner*—Henry A. Bennet

*Attorney, Agent, or Firm*—Dirk J. Veneman; Raymond W. Campbell; David J. Archer

[57] ABSTRACT

A web transfer apparatus is disclosed for transferring a web from a press section to a dryer section. The transfer apparatus includes a dryer fabric extending around the dryer section for conveying the web from the press section to, and around, the dryer section so that excess water remaining in the web after the press section is removed from the web when passing through the dryer section. A first plurality of rotatable rolls movably support the dryer fabric and a frame rotatably supports the first plurality of rolls. The first plurality of rolls includes a lead-in roll which is disposed adjacent to the press section for guiding the web from the press section towards the dryer section. The first plurality of rolls also includes a first transfer roll which is spaced relative to the lead-in roll for guiding the web through the dryer section. A transfer fabric cooperates with the dryer fabric such that the transfer fabric and dryer fabric define therebetween a transfer section which extends along the dryer fabric and between the lead-in roll and the transfer roll. The transfer section permits support of the web therethrough so that the web is easily led to the dryer section while inhibiting any tendency of the web to droop during threading of the web from the press section to the dryer section.

13 Claims, 7 Drawing Sheets

FIG. 1
PRIOR ART
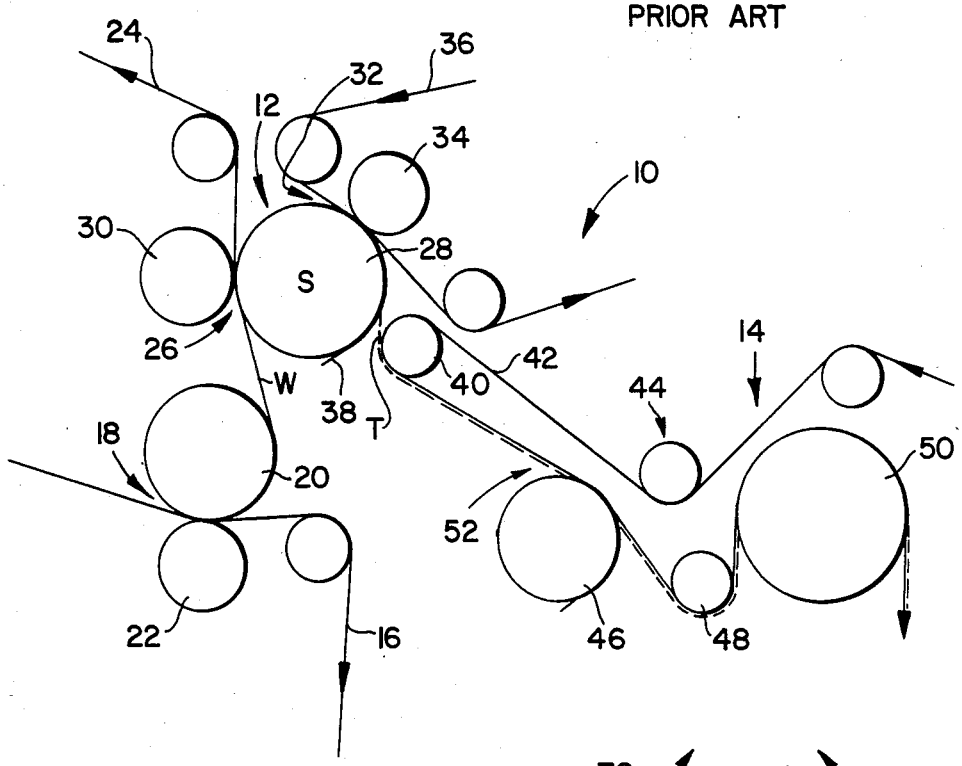
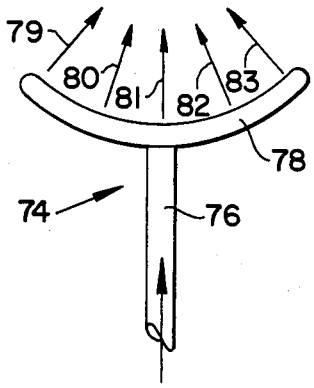
FIG. 4
PRIOR ART
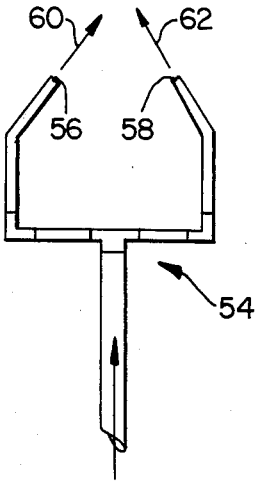
FIG. 2
PRIOR ART
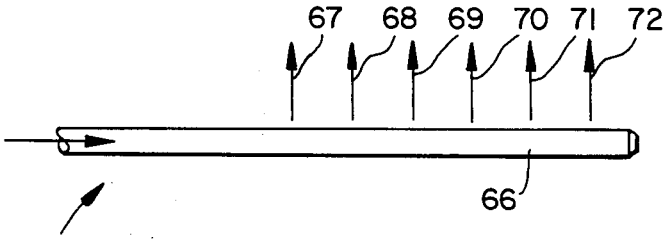
FIG. 3
PRIOR ART

WEB TRANSFER APPARATUS

BACKGROUND OF THE INVENTION

1. Field of the Invention

This invention relates to a web transfer apparatus for transferring a web from a press section to a dryer section. More particularly, this invention relates to a web transfer apparatus for transferring a paper web from a press section to a paper dryer section so that the unsupported distance travelled by the web between the press and the dryer section is minimized.

2. INFORMATION DISCLOSURE STATEMENT

In order to understand the advantages of the present invention, it is necessary to appreciate the problems involved in guiding and, more particularly, in threading a paper web from a press section to—and through—a dryer section.

The transfer of the wet web from the press section to the dryer section of a conventional paper machine is generally accomplished by first transferring a narrow portion of the web to the dryer section. The next step is that of threading that narrow portion of the web through the entire dryer section. When this has been accomplished, the web width is gradually increased until the entire web runs through the dryer section.

In order to understand the aforementioned operation more particularly, reference is made hereinafter to the aforementioned threading operation using a conventional Tri-Vent press section and BelRun dryer section. The Tri-Vent and BelRun sections are both manufactured by Beloit Corporation.

First of all, the transfer from the press section to the dryer section begins after the full width web has been transferred through the press section and is being removed from the press roll by a doctor blade. This full-width web is first cut longitudinally by a suitable water jet prior to the press section so that a small portion of the front edge of the web is separated from the rest of the web. This small portion of the web is typically 2 to 10 inches (5.08 to 25.4 centimeters) in width and is called the "tail". The tail is then blown off the press roll and directed into a nip defined by the dryer fabric and a first dryer of the dryer section. Currently, there are several devices in common usage for blowing the tail off of the press roll and these devices usually use pressurized air for directing the tail towards the dryer section.

There are two main problems associated with the foregoing operation. The first problem is the difficulty in accurately aiming the nozzle of the pressurized air device so that the tail will get caught in the nip of the dryer and dryer fabric. This problem is aggravated by having long open spans between the press roll and the nip. A long span not only increases the directional accuracy required in blowing the tail off the press roll, but also increases the susceptibility of the tail to being disturbed by local air currents. The second problem results because the tail must be blown off the press roll before it contacts the doctor blade. However, if the tail is blown off too far above the doctor blade, it will not have a direct path to the nip due to the disposition therebetween of the lead-in roll of the dryer fabric. Therefore, the zone or "target" within which the tail must be removed from the press roll is limited in size and such removal, therefore, requires great skill on the part of the operator of the air nozzle to correctly remove the tail within this target and to direct such tail towards and between the nip.

Also, there are several other factors which influence the trajectory of the tail from the press roll which makes this portion of the transfer particularly difficult. To enumerate some of these difficulties, there exists a tendency of the web to fall due to gravity. Furthermore, there is a tendency on the part of the tail, to slow down due to air friction.

In addition to the aforementioned problems regarding the actual threading of the tail between the press section and the dryer section, another major problem exists in that when the tail has been threaded, a certain slack in the tail will exist between the press and dryer sections. Once the tail is caught in the nip, the slack in the tail length must be quickly reduced in order to keep the tail from drooping downwardly and coming into contact with the doctor blade or being broken by local air currents. This slack is reduced by running the dryer section at an increment of speed above that of the press section. This increment is called the "draw". The "draw" must be large enough during this operation to quickly take up any slack in the tail, but if this "draw" is too large, the tail will be broken once the slack is removed. Typically, such "draws" are in the range of 2 to 5 percent of the press speed.

The aforementioned problem relative to the "draw" is also aggravated by having a long span, or distance, between the press and dryer sections. A longer span obviously increases the amount of slack which must be quickly taken up by the dryer section.

In order to overcome the aforementioned problems associated with the prior art proposals, Applicant has reduced the length of this span. Although this solution may, at first, be thought to be relatively simple, in practice—when a portion of the dryer section is located inside the framing of the press section, various additional problems arise. These problems include restrictions in the press frame design, various stresses imposed on the press frame, vibrations and access to the press frame. Also, access to the dryer felt and roll removal becomes very difficult. Because of these difficulties in design, it is not uncommon for the distance between the press section and dryer section to be in the range of 8 to 10 feet. (2.44 meters to 3.05 meters)

In an attempt to stabilize the tail on the dryer fabric during threading, it has been found that if the tail maintains good contact with the fabric, it will not be subject to external air currents and will later progress down the dryer section without wandering.

In order to maintain such contact between the tail and the dryer fabric, several devices have previously been installed above the dryer fabric in order to generate and maintain such good contact. These devices include air nozzles and transfer boxes. Also, diverging foil sections have been used as well as vacuum boxes and air foil devices. These tail stabilizing devices cannot effectively support the narrow tail because the vacuum levels created by such transfer boxes or the like, are not adequate. Such inadequate vacuum is caused by the large open area on each side of the tail and the permeability of the fabric which allows air to flow in above the tail and reduce the effective vacuum at the felt surface. While it is true that the vacuum levels can be increased to support the tail, this increased vacuum will then pull the dryer fabric into contact with the transfer box, or the like when the fabric is later sealed by the full-width web.

The aforementioned long span, or distance travelled by the tail between the press roll and the dryer section, is aggravated because such deflection of the dryer felt due to application of vacuum to the transfer box increases almost by a factor of four with the span length.

With regard to the use of air nozzles for maintaining close contact between the tail and the dryer fabric, these air nozzles have proven to be effective for relatively low speed operations but the spent air is found to cause more disruptions and movement of the tail at higher speeds.

Regarding a further aspect of transferring the web from the press section to the dryer section, once the tail has been transferred to the dryer fabric, it becomes necessary to thread the tail from the first dryer cylinder down the dryer section to the last dryer cylinder. This can be accomplished either with the use of threading air jets or, more commonly, with the use of threading ropes.

When using threading ropes, the tail must be separated from the dryer fabric and either manually, or automatically moved towards the front (or edge) of the machine until such tail is caught between the threading ropes. Although this aspect of the transfer is not usually a problem, the design of the press to dryer transfer apparatus must have provisions for this operation.

More specifically, there must be at least a short, open draw with enough access to move the tail from the dryer fabric so that the tail can be moved into the rope nip.

Once the tail has been threaded down the dryer section, the next step is to widen the tail to the full width of the web. During this widening process, good contact must be maintained between the dryer fabric and the tail. If this is not the case, the tail will become slack and will break.

The tail is particularly susceptible to separating from the dryer fabric at the edges of the tail where the transfer box device is least able to maintain the required support vacuum. And—once again, the long span between the press and dryer sections aggravates this problem by increasing the weight of the unsupported tail.

The final step in transferring from the press to the dryer section includes continuing the support of the full width web. Here again, the edges of the web are the most difficult part of the web to support. With long spans, there exists a limit on the amount of vacuum that can be applied or induced above the fabric because of the aforementioned fabric deflection. Further, the long span also increases the weight of the unsupported web thereby causing it to stretch and increasing the time for the viscoelastic web to relax and lose its internal tension.

As can be appreciated by those skilled in the art, there exist several problems as enumerated herein which present themselves when attempting to transfer a web from a press to a dryer section.

The present invention seeks to overcome the aforementioned inadequacies of the prior art proposals by providing a web transfer apparatus which includes a secondary, or transfer fabric, which cooperates with the dryer fabric such that the web during the majority of the travel between the press to the dryer section is supported simultaneously from both sides.

Therefore, it is a primary objective of the present invention to provide a web transfer apparatus in which the provision of a transfer fabric effectively reduces the length of the unsupported span.

A further objective of the present invention is the provision of a web transfer apparatus in which the guide roll for the transfer fabric is located relatively close to the lead-in roll of the dryer fabric thereby reducing the span to a minimum.

Another object of the present invention is the provision of a web transfer apparatus in which the guide roll bears only slightly against the dryer fabric in order to minimize the angle of wrap of the web as the web moves along the dryer fabric and then between the felts or fabrics in the transfer section.

Another object of the present invention is the provision of a web transfer apparatus in which the transfer apparatus is provided with a second air deflector to insure that the tail follows the dryer fabric as the tail emerges from the transfer section.

These, and other objects of the present invention, will be readily apparent to those skilled in the art by a consideration of the detailed description hereinafter and by reference to the attached drawings.

Although the present invention is described with particular reference to transferring a web between a Tri-Nip press section and a UNIRUN dryer section, it should be appreciated by those skilled in the art that the present invention is not limited by the description of the preferred embodiment. Tri-Nip is a registered trademark of Beloit Corporation. Rather, the present invention is defined by the appended claims which envisage various modifications and applications which fall within the spirit and scope of the present invention as defined by the appended claims.

SUMMARY OF THE INVENTION

The present invention relates to a web transfer apparatus and method for transferring a web from a press section to a dryer section. The apparatus includes a dryer fabric extending around the dryer section for conveying the web from the press section to, and around, the dryer section so that excess water remaining in the web after the press section is removed from the web when the web passes through the dryer section. A first plurality of rotatable rolls movably support the dryer fabric and a frame rotatably supports the first plurality of rolls. The first plurality of rolls includes a lead-in roll which is disposed adjacent the press section for guiding the web from the press section towards the dryer section. The first plurality of rolls also includes a first transfer roll means which is spaced relative to the lead-in roll for guiding the web through the dryer section. A transfer fabric cooperates with the dryer fabric such that the transfer fabric and dryer fabric define therebetween a transfer section which extends along the dryer fabric and between the lead-in roll and the transfer roll means. The transfer section permits support of the web therethrough so that the web is easily led to the dryer section while inhibiting any tendency of the web to droop during threading of the web from the press section to the dryer section.

In a specific embodiment of the present invention, the first plurality of rolls also includes a plurality of dryers and a plurality of transfer rolls such that each dryer of the plurality of dryers alternates with a transfer roll of said plurality of transfer rolls so that the dryer fabric moves around the plurality of transfer rolls and the plurality of dryer drums as a UNIRUN dryer section.

Furthermore, the transfer rolls, dryer drums, and first transfer roll means are all rotatably supported by a dryer section frame. The lead-in roll and the first transfer roll are, respectively, vacuum rolls. The web transfer apparatus also includes a second plurality of rolls for movably supporting the transfer fabric with the second plurality of rolls being rotatably supported by the press section and dryer section frames. A plurality of tensioning rolls bear against the transfer fabric for tensioning the transfer fabric so that the transfer fabric bears against, and cooperates with, the dryer fabric for defining the transfer section therebetween. The second plurality of rolls also includes a guide roll for guiding the web into the transfer section between the dryer fabric and the transfer fabric. A first air deflector is disposed adjacent to the guide roll for deflecting the air which is traveling with the transfer fabric away from the web.

In an alternative embodiment of the present invention, instead of the provision of vacuum rolls for the lead-in roll and the first transfer roll, a plain shell or grooved shell is used. A second air deflector is disposed adjacent to the first transfer roll means for deflecting the web away from the transfer fabric towards the dryer fabric when the web emerges from the transfer section.

Additionally, a third air deflector is disposed adjacent to a roll of the second plurality of rolls such that the roll supports the transfer fabric between the first transfer roll and the plurality of tension rolls. The third air deflector deflects the web away from the transfer fabric in the event of the web failing to transfer from the transfer felt to the dryer fabric when the web emerges from the transfer section. The third air deflector thereby inhibits the possibility of the web winding around the subsequent tensioning rolls. Means are provided for driving one of the rolls of the second plurality of rolls so that the transfer fabric is moved at approximately the same speed as the speed of the dryer fabric. Preferably, this driven roll is the guide roll because of the large felt wrap.

The present invention minimizes the distance travelled by the unsupported web between the press and the dryer section thereby minimizing the possibility of the web drooping down and breaking prior to completion of the threading operation.

BRIEF DESCRIPTION OF THE DRAWINGS

FIG. 1 is a side elevational view of a prior art web transfer apparatus;

FIG. 2 is a plan view of a prior art caliper type pressurized air device;

FIG. 3 is a plan view of a prior art air pipe type pressurized air device;

FIG. 4 is a plan view of a prior art air yoke type pressurized air device;

Similar reference numerals refer to similar parts throughout the various figures of the drawings.

DETAILED DESCRIPTION OF THE DRAWINGS

Figure 5:
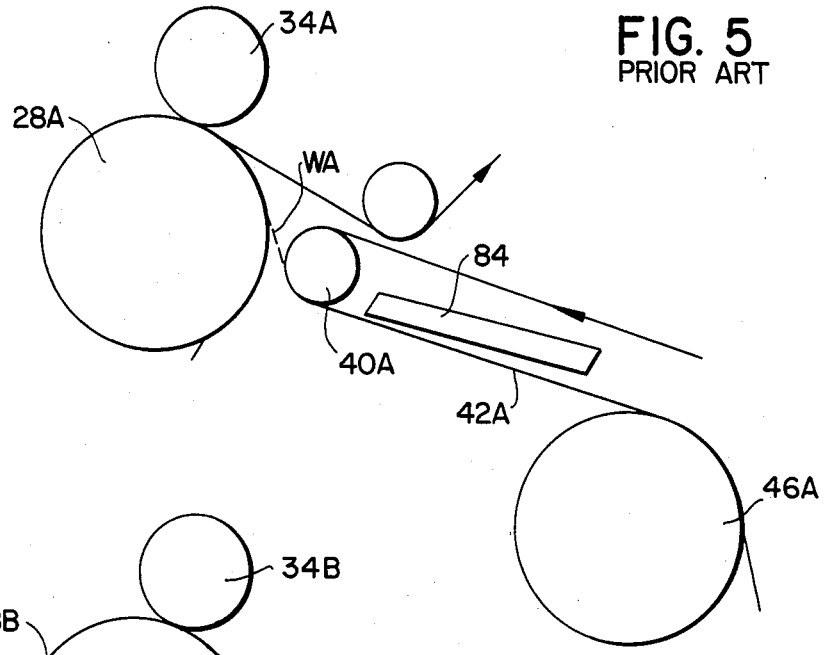
FIG. 5 PRIOR ART
FIG. 5 is a side elevational view of a prior art foil type web transfer apparatus.

FIG. 1 is a side elevational view of a prior art web transfer apparatus generally designated 10 showing a Tri-Nip press section generally designated 12 and a UNIRUN dryer section generally designated 14.

The press section 12 includes a bottom felt 16 which extends through a first nip generally designated 18 defined by cooperating press rolls 20 and 22 respectively. A second press felt 24 also extends through the nip 18 with a web W disposed between the felts 16 and 24 respectively. The web W supported by the second felt 24 extends between a second nip generally designated 26 defined by a first press roll 28 and roll 30. The web W is carried by the first press roll 28 around the press roll 28 and between a third nip generally designated 32 defined by the first press roll 28 and a roll 34. A third press felt 36 also extends through the third nip 32 such that the web W is disposed between the third press felt 36 and the first press roll 28. A doctor blade 38 is disposed beneath and adjacent to the first press roll 28 such that the web W supported on the first press roll 28 is parted from the first press roll 28 by means of the doctor blade 38. A lead-in roll 40 is disposed adjacent to the first press roll 28 at a location between the doctor blade 38 and the roll 34. A dryer fabric 42 is guided by a first plurality of rolls generally designated 44 including the lead-in roll 40 after which the dryer fabric 42 extends towards a baby, or lead-in dryer drum 46 onto a transfer roll 48 and thence onto a first dryer drum 50 of a series of UNIRUN dryers (not shown).

As can be seen from FIG. 1, when the tail T is parted from the surface S of the press roll 28, the tail T must be guided around the lead-in roll 40 and caused to come into close contact with the dryer fabric 42 between the lead-in roll 40 and the baby dryer drum 46. As stated hereinbefore, this has presented many problems, not least of which is the tendency of such tail T to droop downwardly relative to the lead-in roll 40 and dryer fabric 42.

FIGS. 2 to 4 show various types of pressurized air devices commonly used in threading a tail into a nip 52 defined by the dryer fabric 42 and the baby dryer 46. FIG. 2 shows a caliper type device generally designated 54 having opposed nozzles 56 and 58 respectively. The tail T of the web W is guided by the air jets 60 and 62 ejected from this device 54.

FIG. 3 shows another type of pressurized air device generally designated 64 which is simply a pipe 66 having a plurality of air nozzles (not shown) for directing air as indicated by arrows 67,68,69,70,71 and 72 laterally relative to the pipe 66.

FIG. 4 shows a further type of pressurized air device 74 having an air supply pipe 76 connected to a curved cross pipe 78 having a plurality of nozzles for directing convergent currents of air 79,80,81,82 and 83 for guiding the tail T within the nip 52.

FIG. 5 shows a press roll 28A and a roll 34A with the web WA leaving the press roll 28A, passing around the lead-in roll 40A and being held against the dryer fabric 42A between the lead-in roll 40A and a baby dryer drum 46A by a foil type device 84.

Figure 6:
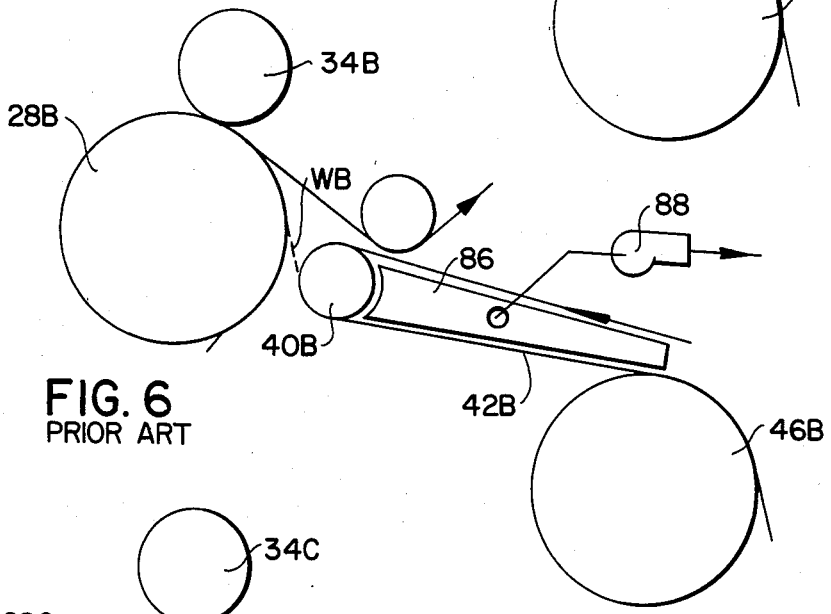
FIG. 6 PRIOR ART
FIG. 6 is a side elevational view of a prior art vacuum type web transfer apparatus.

FIG. 6 shows a further prior art device similar to that shown in FIG. 5 but using an air box 86 connected to a fan 88 which creates a partial vacuum within the air box 86. The other parts shown in FIG. 6 are identical to those shown in FIG. 5 and are designated by the same numerals as the corresponding parts of FIG. 5 but with the suffix B added thereto.

Figure 7:
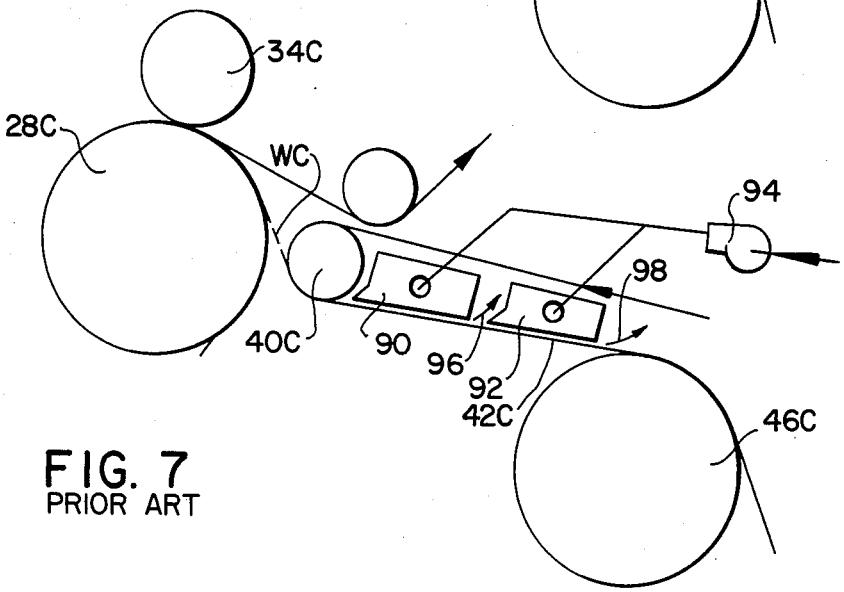
FIG. 7 PRIOR ART
FIG. 7 is a side elevational view of a prior art air foil type web transfer apparatus.

FIG. 7 is a prior art device similar to that shown in FIG. 6 but instead of the air box 86, a pair of air foil type boxes 90 and 92 are both connected to an air fan 94 which pressurizes the air foil boxes 90 and 92 to create curtains of air 96 and 98 respectively for urging the tail against the dryer fabric. In other respects, the apparatus of FIG. 7 is the same as that shown in FIG. 6 and similar parts have the same numerals with the suffix C added thereto.

Figure 8:
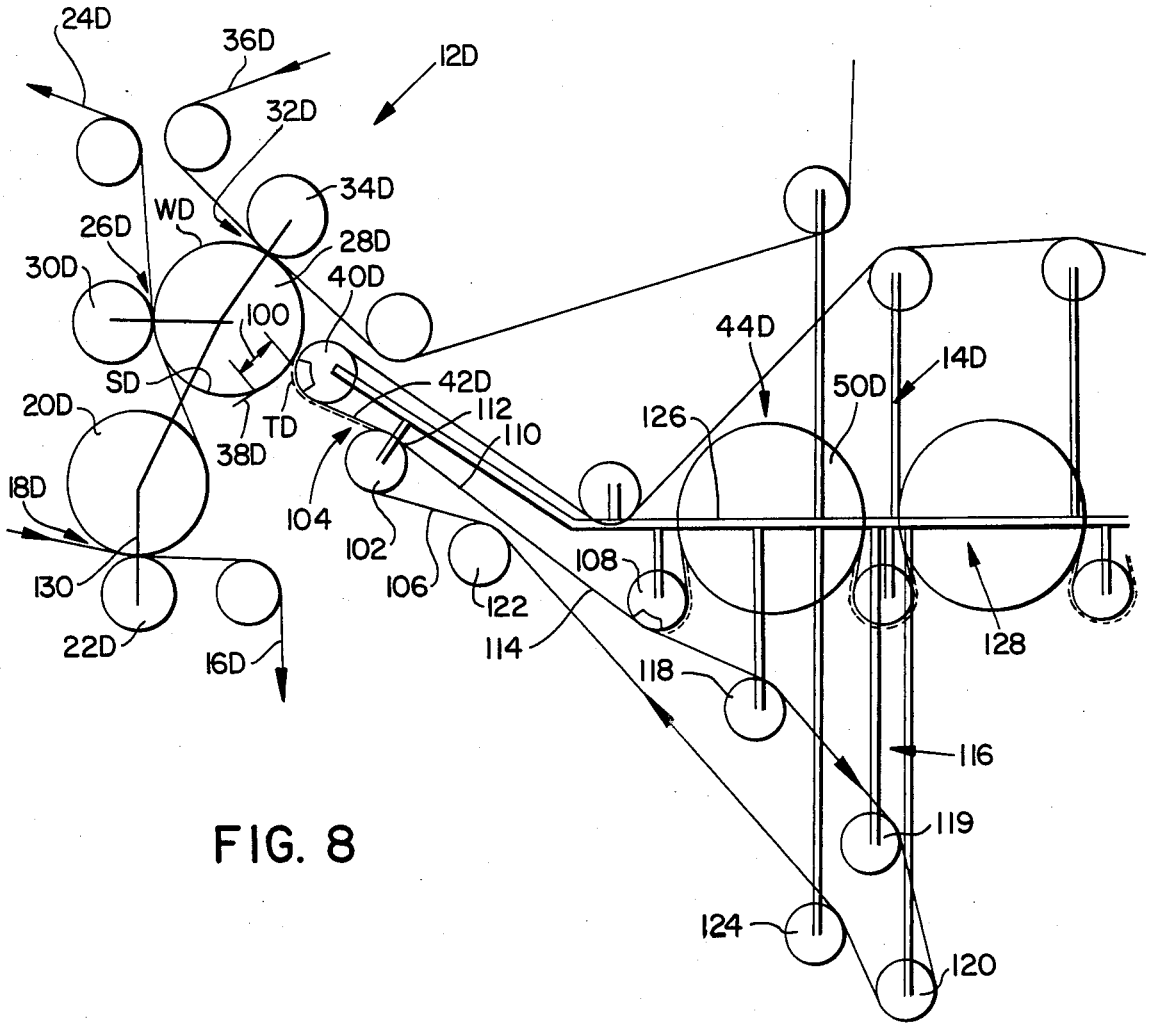
FIG. 8 is a side elevational view of a web transfer apparatus according to the present invention.

According to the present invention as shown in FIG. 8, the web WD emerging from between a third press felt 36D and the first press roll 28D passes downwardly toward a doctor blade 38D. A lead-in roll 40D is disposed between a roll 34D and the doctor blade 38D and is in close proximity to the first press roll 28D. As the web WD passes the lead-in roll 40D towards the doctor blade 38D, a tail removal zone 100, is defined between the lead-in roll 40D and the doctor blade 38D. A tail TD of the web WD is urged by the aforementioned pressurized air devices 54, 64 or 74 from the surface SD of the first press roll 28D within the zone 100 and the tail TD is directed towards the dryer fabric 42D between the lead-in roll 40D and a guide roll 102 such that the tail TD is directed within a nip 104 defined by the guide roll 102 and the dryer fabric 42D. A transfer fabric 106 extends around the guide roll 102 and towards a first transfer roll 108. The dryer fabric 42D at the first transfer roll 108 parts from the transfer fabric 106 such that the dryer fabric 42D and the transfer fabric 106 defined therebetween a transfer section 110 which extends from the guide roll 102 to the first transfer roll means 108. This transfer section 110 has a first and a second end 112 and 114 respectively with the first end 112 being disposed adjacent to the press section 12D and the second end 114 being disposed adjacent to the dryer section 14D. The transfer fabric 106 extends around a second plurality of rolls generally designated 116 which includes rolls 118, 119 and 120 and guide roll 102. A first and second tensioning roll 122 and 124 respectively, bear against the transfer fabric 106 so that the transfer fabric 106 bears against, and cooperates with, the dryer fabric 42D for defining the transfer section 110 therebetween. The tensioning rolls 122 and 124 and the second plurality of rolls 116 may be rotatably supported by the dryer section frame 126 or the press section frame 130.

The dryer fabric extends around the dryer section 14D for conveying the web WD from the press section 12D to, and around, the dryer section 14D so that excess water remaining in the web WD after the press section 12D is removed from the web WD when passong through the dryer section 14D. A first plurality of rotatable rolls generally designated 44D movably support the dryer fabric 42D. A frame means generally designated 128 rotatably supports the first plurality of rolls 44D. The first plurality of rolls 44D includes the lead-in roll 40D which is disposed adjacent to the press section 12D for guiding the web WD from the press section 12D towards the dryer section 14D. The first transfer roll means 108 is disposed adjacent to the dryer section 14D for guiding the web WD from the lead-in roll 40D past the transfer roll means 108 and onto the dryer section 14D. The transfer fabric 106 cooperates with the dryer fabric 42D such that the transfer fabric 106 and the dryer fabric 42D define therebetween, the transfer section 110 which extends along the dryer fabric 42D and between the lead-in roll 40D and the transfer roll 108. The transfer section 110 permits support of the web WD therethrough so that the web WD is easily led to the dryer section 14D while eliminating any possibility for the web WD to droop during threading of the web WD from the press section 12D to the dryer section 14D.

The frame means generally indicated at 128 includes a dryer section frame 126 for rotatably supporting the transfer roll means 108 and the dryer drum 50D. The frame means 128 also includes a press section frame 130. The first plurality of rolls includes the plurality of dryers of which 50D is shown. Furthermore, of the plurality of transfer rolls, each dryer of the plurality of dryers alternates with a transfer roll of the plurality of transfer rolls such that the dryer fabric 42D moves around the plurality of transfer rolls and the plurality of dryer drums as a UNIRUN dryer section.

In one embodiment of the present invention, the lead-in roll 40D is a vacuum roll for facilitating the guidance of the web WD from the press section 12D towards the dryer section 14D. Also, the first transfer roll means 108 is a vacuum roll for urging the web WD away from the transfer section 110 around the first transfer roll means 108 and onto the dryer section 14D.

The first end 112 of the transfer section 110 is disposed between the lead-in roll 40D and the first transfer roll means 108 while the second end 114 of the transfer section 110 is disposed adjacent to the first transfer roll means 108.

Figure 9:
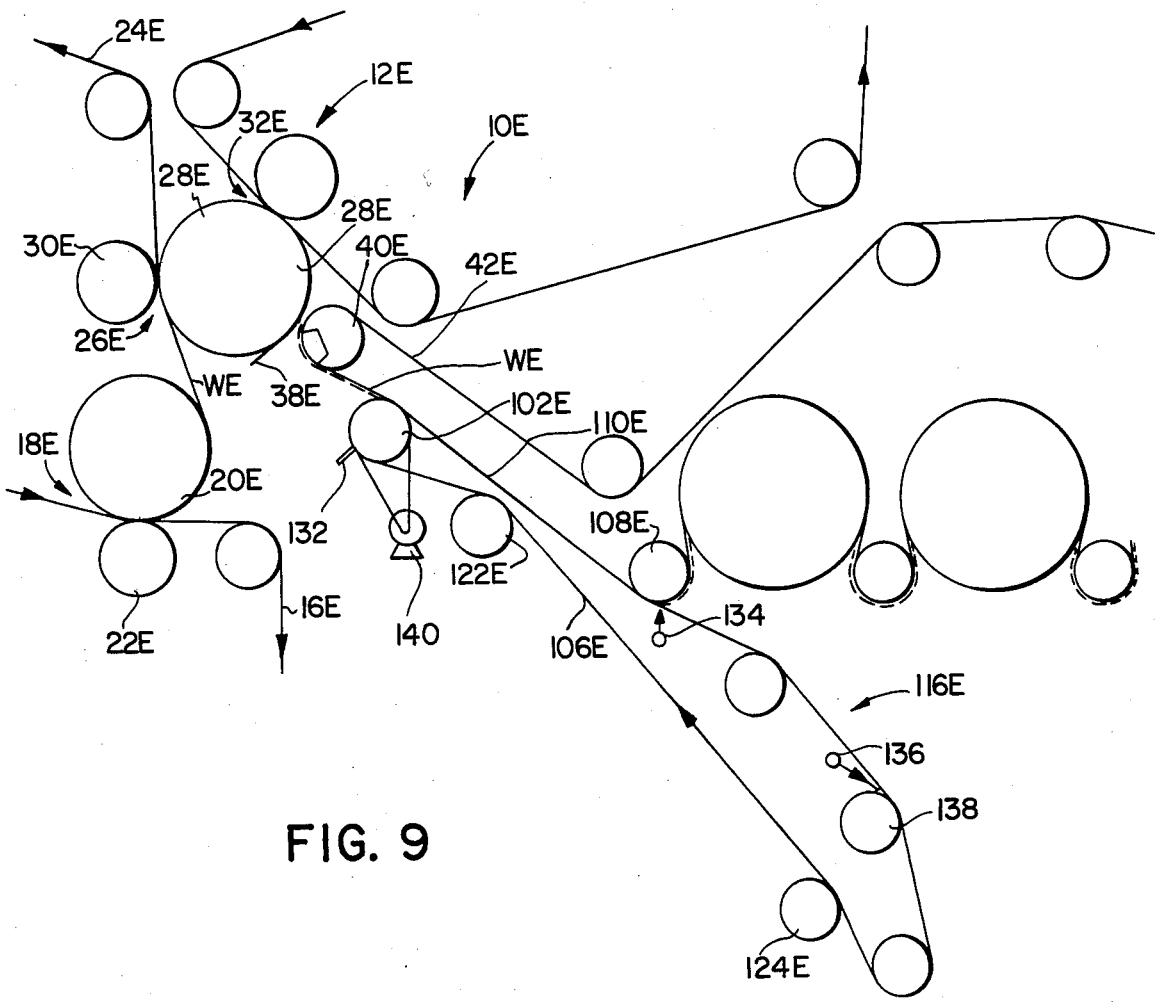
FIG. 9 is a side elevational view of a second embodiment of the web transfer apparatus according to the present invention.

In an alternative embodiment of the present invention as shown in FIG. 9, the web transfer apparatus 10E includes a first air deflector 132 disposed adjacent to the guide roll 102E for deflecting the air which is traveling with the transfer fabric 106E away from the web WE thereby minimizing disturbance of the web WE during the transfer of the web.

Furthermore, the web transfer apparatus 10E includes a second air deflector 134 disposed adjacent to the first transfer roll 108E for deflecting the web WE or tail TE away from the transfer fabric 106E towards the dryer fabric 42E when the web WE or tail TE emerges from the transfer section 110E. In this embodiment of FIG. 9, it is unnecessary to provide the transfer roll 108E as a vacuum roll as the deflector 134 serves the same purpose and is less costly and the transfer roll means 108E can be a plain or a grooved shell roll.

Additionally, the web transfer apparatus 10E includes a third air deflector 136 which is disposed adjacent to a roll 138 of the second plurality of rolls 116E. The roll 138 supports the transfer fabric 106E between the first transfer roll 108E and the plurality of tensioning rolls 124E and 122E. The third air deflector 136 deflects the web WE or the tail TE away from the transfer fabric 106E in the event of the web WE or the tail TE failing to transfer from the transfer fabric 106E to the dryer fabric 42E when the web WE emerges from the transfer section 110E. The third air deflector 136 thereby inhibits the possibility of the web WE or tail TE winding around the subsequent tensioning rolls 124E and 122E.

In the alternative embodiment of the invention, the web transferring apparatus also includes means 140 for rotatably driving one of the rolls of the second plurality of rolls and preferably the guide roll 102E such that the transfer fabric 106E is moved at approximately the same speed as the speed of the dryer fabric 42E.

In both embodiments of the present invention, the press sections 12D and 12E also include a press roll 28D and 28E respectively which are disposed adjacent to the lead-in rolls 40D and 40E respectively and first doctor blades 38D and 38E which cooperate with the press rolls 28D and 28E for removing the web WD or WE from the press roll as the web emerges past the lead-in roll from the press section.

In operation of the present invention the tail of the web is lifted from the surface of the first press roll by means of a suitable pressurized air device as shown in FIGS. 2 to 4. This removal of the tail is accomplished within the zone 100 as shown in FIG. 8. The tail is directed towards the nip 104 as shown in FIG. 8 and the tail is drawn towards lead-in roll 40D, particularly in view of the lead-in roll 40D being a vacuum roll. Because of the cooperation between dryer fabric 42D and transfer fabric 106 as shown in FIG. 8, the tail supported on both sides thereof is guided from the guide roll 102 towards the transfer roll means 108 where the web follows the dryer fabric as the web emerges from the second end 114 of the transfer section 110. In the embodiment shown in FIG. 8, such transfer of the web to the dryer fabric is facilitated by the first transfer roll means 108 being a vacuum roll. Moreover, by virtue of the transfer fabric 106 extending closely towards the first press roll 28D, the distance that the web has to travel unsupported from the first press roll 28D before it becomes supported on both sides within the transfer section 110, is minimal thereby inhibiting the aforementioned problems associated with transferring and threading a web from a press section to a dryer section.

In the second embodiment of the present invention, the operation is similar to that described with reference to the embodiment of FIG. 8. However, instead of the first transfer roll being a vacuum roll as in the case of the embodiment of FIG. 8, the roll means 108E may be a plain roll or a grooved roll provided with a second air deflector 134 for effecting transfer of the tail onto the dryer fabric 42E. Further, in the embodiment shown in FIG. 9, the driving means 140 enables the transfer fabric 106E to move at approximately the same speed as the dryer fabric 42E thereby inhibiting any tendency of scuffing of the tail or web during passage through the transfer section 110E.

Additionally, in the embodiment shown in FIG. 9, a first air deflector 132 is provided adjacent to the guide roll 102E to assist in directing the tail within the nip defined by the guide roll 102E and the dryer fabric 42E.

The third air deflector 136 serves the purpose of removing from the transfer fabric 106E the tail, or web, in the event of failure of the tail or web to follow the dryer fabric 42E. Such third air deflector prevents the web from becoming entangled around the tensioning roll 124E.

As shown in both FIGS. 8 and 9, the guide roll 102 and 102E respectively, bear only slightly against the dryer fabric 42D and 42E respectively, thereby avoiding any sharp change in direction of the tail, or web, during passage along the transfer section. Such avoidance of scuffing of the web between the fabrics is achieved by the present invention by minimizing the angles of reversing of the double felt wrap in the transfer section.

In the embodiments of FIGS. 8 and 9, the first, second and third air deflectors may be air nozzles.

Figure 10:
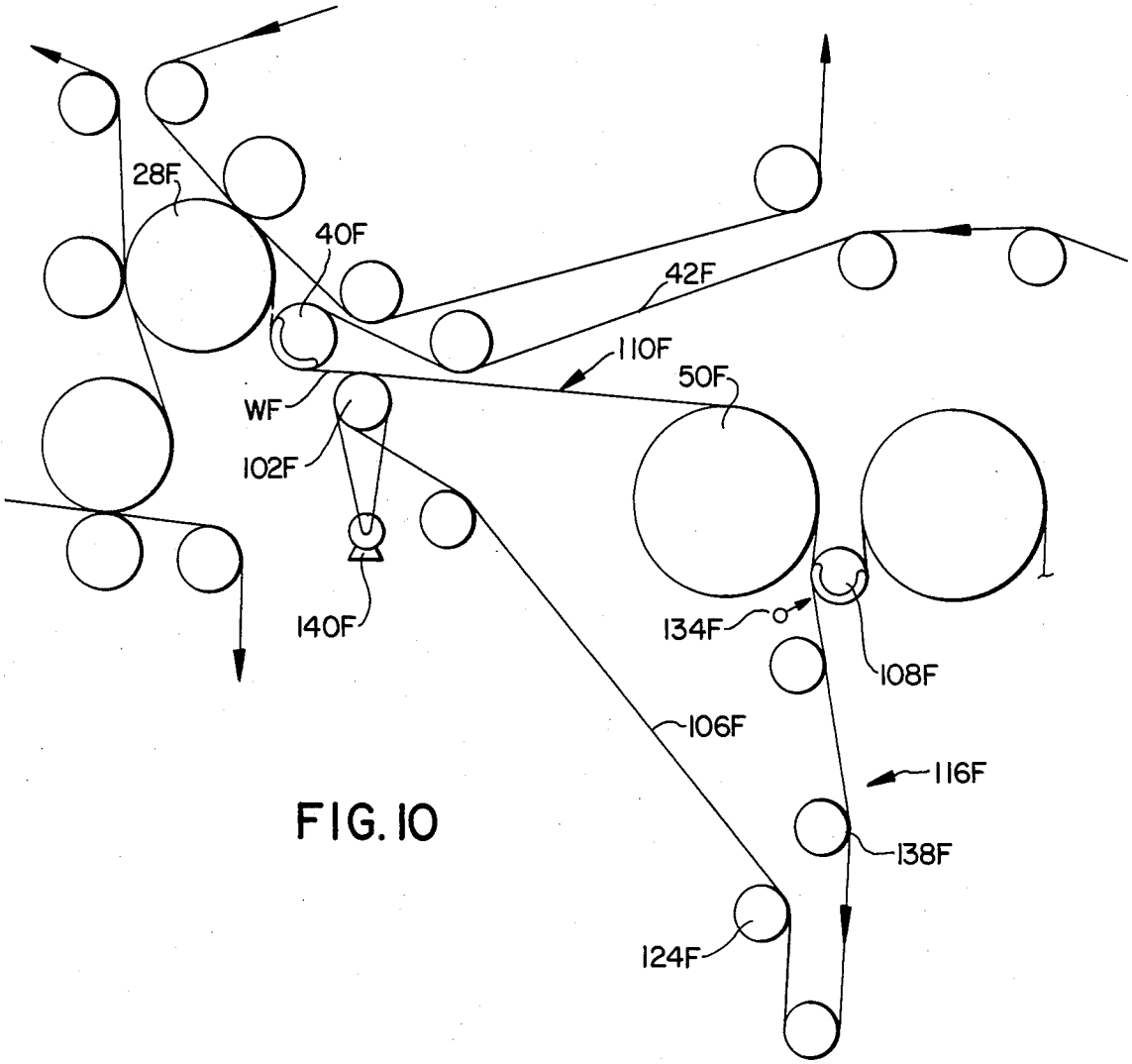
FIG. 10 is a side elevational view of a third embodiment of the transfer apparatus according to the present invention.

FIG. 10 shows a third embodiment of the present invention with similar parts thereof referred to by the same numerals applied to the first embodiment with the suffix F added thereto. As shown in FIG. 10, the web WF is led through the transfer section 110F between the dryer fabric 42F and the transfer fabric 106F. However, the cooperating fabrics 42F and 106F pass around the first dryer 50F prior to the dryer fabric 42F and web WF extending round the transfer roll means 108F.

Figure 11:
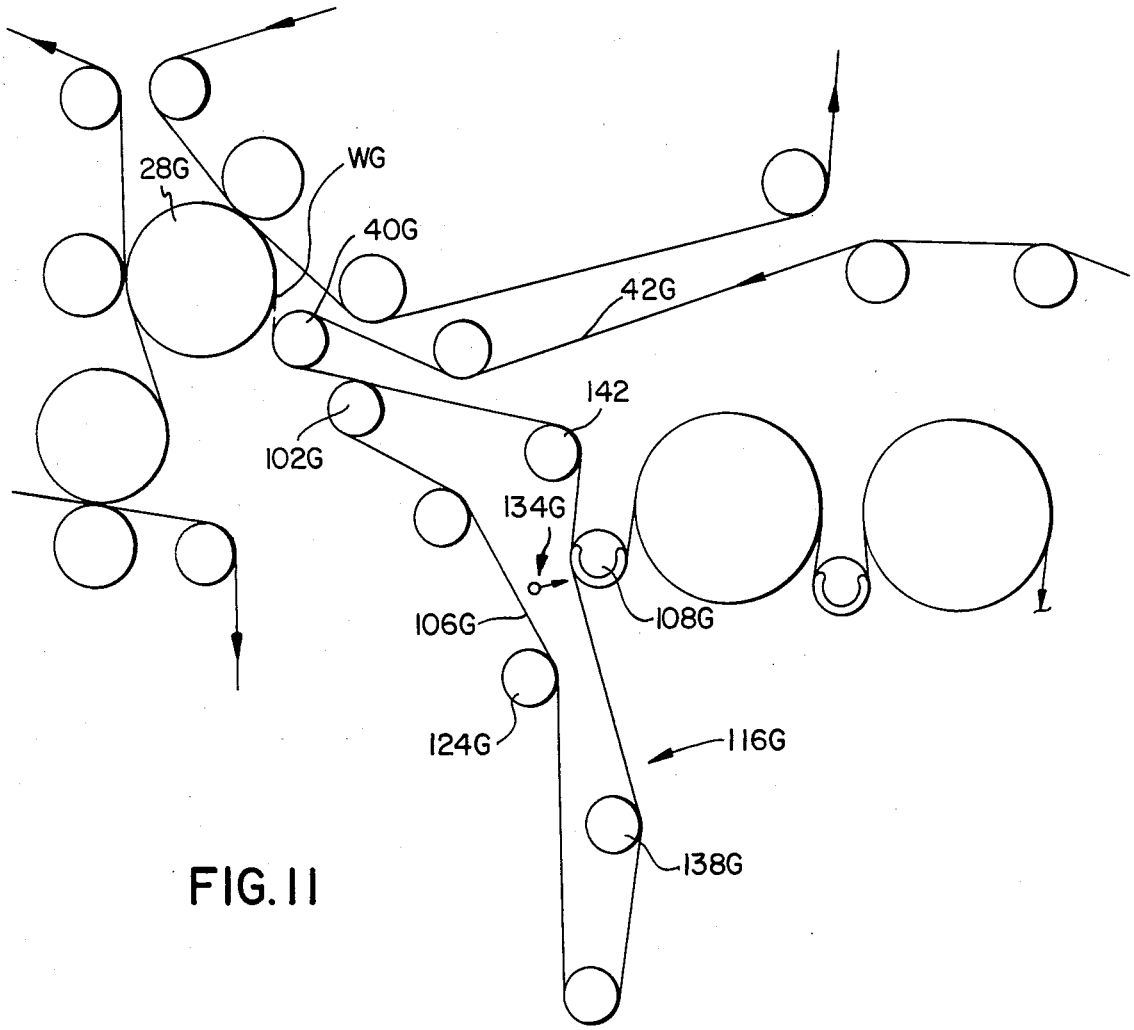
FIG. 11 is a side elevational view of a fourth embodiment of the transfer apparatus according to the present invention.

The fourth embodiment of the present invention, as shown in FIG. 11 is similar to the embodiment shown in FIG. 8 and similar reference numerals are used in FIG. 11 with the suffix G added thereto. In FIG. 11, the cooperating dryer fabric 42G and transfer fabric 106G extend around an auxiliary roll 142 prior to the dryer fabric 42G and web WG extending round the transfer roll means 108G.

Figure 12:
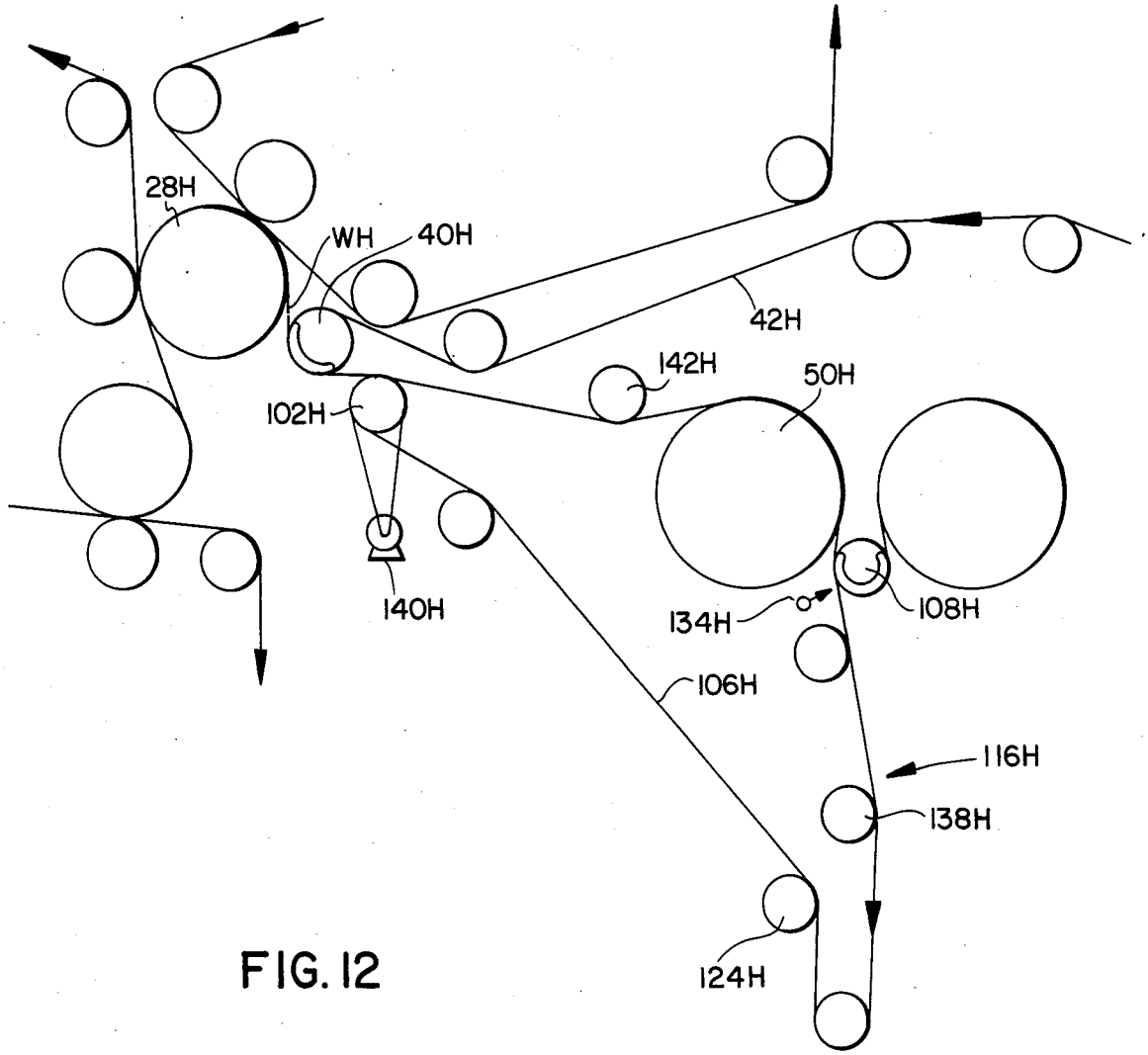
FIG. 12 is a side elevational view of a fifth embodiment of the transfer apparatus according to the present invention.

FIG. 12 shows a fifth embodiment of the present invention which is similar to the embodiment shown in FIG. 11, however, the cooperating fabrics 42H and 106H extend around an auxiliary roll 142H and then around the first dryer 50H prior to the dryer fabric 42H and web WH passing around the transfer roll means 108H. Similar reference numbers with the suffix H added thereto are used in FIG. 12 to indicate similar parts to the preceeding embodiments.

In operation of the embodiments shown in FIGS. 10, 11 and 12, the web, or tail, is guided through the transfer section from the guide roll to the transfer roll means such that the unsupported span traversed by the web, or tail, is reduced to a minimum. Furthermore, reversing of the double felt wrap is minimized and air nozzle transfer of the tail to the nip 104 is facilitated.

In the prior art, certain problems were experienced when attempting to pass a web sandwiched between a top and bottom fabric between the dryer section. Such problems came about because not all the dryers were cooled by direct contact with the web, therefore, such non-contacted dryers expanded to a larger diameter. Secondly, the top felt wrapped around certain of the dryers and not others, thereby increasing the effective diameter of the dryers around which both felts wrapped. Such different speeds resulted in scuffing between the bottom and top fabrics.

The aforementioned problem is avoided by the embodiments shown in FIGS. 10 and 12 by not driving the first dryer 50F and 50H respectively with the subsequent dryer. In the embodiment shown in FIGS. 10 and 12, the first dryer 50F and 50H respectively are driven by the transfer fabric 106F and 106H respectively.

In all the various embodiments of the present invention, the dryer fabric and the transfer fabric are arranged to run at approximately the same speed and each fabric is arranged to run at a fixed speed along the entire length of the respective fabrics.

The foregoing detailed description illustrates five embodiments of the present invention. It will be appreciated by those skilled in the art that there are many variations of the described embodiments that fall within the spirit and scope of the present invention as defined by the appended claims. The present invention provides a reliable and practical means for assisting transfer of a web between a press and dryer section of a papermaking machine.

What is claimed is:

1. A web transfer apparatus for transferring a web from a press section to a dryer section, said transfer apparatus comprising:

a dryer fabric extending around the dryer section for conveying the web from the press section to, and around, the dryer section so that excess water remaining in the web after the pressing section is removed from the web when passing through the dryer section;

a first plurality of rotatable rolls for movably supporting said dryer fabric;

frame means for rotatably supporting said first plurality of rolls;

said first plurality of rolls including:

a lead-in roll disposed adjacent to the press section for guiding the web from the press section towards the dryer section;

a first transfer roll means spaced relative to said lead-in roll for guiding the web through the dryer section;

a transfer fabric cooperating with said dryer fabric such that said transfer fabric and said dryer fabric define therebetween a transfer section which extends continuously along said dryer fabric and said transfer section being disposed between said lead-in roll and said first transfer roll means;

said first transfer roll means being a vacuum roll for urging the web away from said transfer fabric around said first transfer roll means; and said transfer section permitting support of the web therethrough so that the web is easily led to the dryer section while inhibiting any tendency of the web to droop during threading of the web from the press section to the dryer section.

2. A web transfer apparatus as set forth in claim 1 wherein said first plurality of rolls further includes:

a plurality of dryers;

a plurality of transfer rolls;

each dryer of said plurality of dryers alternating with a transfer roll of said plurality of transfer rolls such that said dryer fabric moves around said plurality of transfer rolls and said plurality of dryers as a uni-run dryer section.

3. A web transfer apparatus as set forth in claim 2 wherein said frame means includes:

a dryer section frame for rotatably supporting said dryers and said first transfer roll means;

a press section frame for rotatably supporting said lead-in roll.

4. A web transfer apparatus for transferring a web from a press section to a dryer section, said transfer apparatus comprising;

a dryer fabric extending around the dryer section for conveying the web from the press section to, and around, the dryer section so that excess water remaining in the web after the pressing section is removed from the web when passing through the dryer section;

a first plurality of rotatable rolls for movably supporting said dryer fabric;

frame means for rotatably supporting said first plurality of rolls;

said first plurality of rolls including;

a lead-in roll disposed adjacent to the press section for guiding the web from the press section towards the dryer section;

a first transfer roll means spaced relative to said lead-in roll for guiding the web through the dryer section;

a transfer fabric cooperating with said dryer fabric such that said transfer fabric and said dryer fabric define therebetween a transfer section which extends along said dryer fabric and between said lead-in roll and said first transfer roll means;

said transfer section permitting support of the web therethrough so that the web is easily led to the dryer section while inhibiting any tendency of the web to droop during threading of the web from the press section to the dryer section;

said transfer section having a first and a second end, said first end being disposed adjacent to the press section and said second end being disposed adjacent to said first transfer roll means;

said first end of said transfer section being disposed between said lead-in roll and said first transfer roll means; and said second end of said transfer section being disposed adjacent to said first transfer roll means.

5. A web transfer apparatus as set forth in claim 1 further including:

a second plurality of rolls for movably supporting said transfer fabric;

a dryer section frame for rotatably supporting at least one roll of said second plurality of rolls;

a plurality of tensioning rolls bearing against said transfer fabric for tensioning said transfer fabric so that said transfer fabric bears against, and cooperates with, said dryer fabric for defining said transfer section therebetween.

6. A web transfer apparatus as set forth in claim 5 wherein at least one of said tensioning rolls is rotatably supported by said dryer section frame.

7. A web transfer apparatus as set forth in claim 5 wherein said second plurality of rolls includes:

a guide roll for guiding the web into said transfer section between said dryer fabric and said transfer fabric.

8. A web transfer apparatus as set forth in claim 7 further including:

a first air deflector disposed adjacent to said guide roll for deflecting air away from said dryer fabric thereby minimizing the disturbance of the web during threading of the web into the transfer section.

9. A web transfer apparatus as set forth in claim 7 further including:

a second air deflector disposed adjacent to said first transfer roll means for deflecting the web away from said transfer fabric toward said dryer fabric when the web emerges from said transfer section.

10. A web transfer apparatus as set forth in claim 7 further including:

a third air deflector disposed adjacent to a roll of said second plurality of rolls, said roll supporting said transfer fabric between said first transfer roll means and said plurality of tensioning rolls, said third air deflector deflecting the web away from said transfer fabric in the event of the web failing to transfer from said transfer felt to said dryer fabric when the web emerges from said transfer section, said third air deflector thereby inhibiting the possibility of the web winding around one of said tensioning rolls.

11. A web transfer apparatus as set forth in claim 7 further including:

means for rotatably driving said guide roll such that said transfer fabric is moved at approximately the same speed as the speed of said dryer fabric.

12. A web transfer apparatus as set forth in claim 1 wherein the press section further includes:

a first press roll disposed adjacent to said lead-in roll;

a first doctor cooperating with said first press roll for removing the w®b from ®aid first press roll as the web emerges past said lead-in roll from the press section.

13. A web transfer apparatus for transferring a web from a press section to a dryer section, said transfer apparatus comprising:

a dryer fabric extending around the dryer section for conveying the web from the press section to, and around, the dryer section so that excess water remaining in the web after the press section is removed form the web when passing through the dryer section;

a first plurality of rotatable rolls for movably supporting said dryer fabric;

frame means for rotatably supporting said first plurality of rolls;

said first plurality of rolls including:

a lead-in roll disposed adjacent to the press section for guiding the web from the press section towards the dryer section;

a first transfer roll disposed adjacent to the dryer section for guiding the web from said lead-in roll past said transfer roll and onto the dryer section;

a transfer fabric cooperating with said dryer fabric such that said transfer fabric and said dryer fabric define therebetween a transfer section which extends continuously along said dryer fabric and said transfer section being disposed between said lead-in roll and said transfer roll;

said first transfer roll being a vacuum roll for urging the web away from the transfer fabric around said first transfer roll;

said transfer section permitting support of the web therethrough so that the web is easily led to the dryer section while inhibiting any tendency of the web to droop during threading of the web from the press section to the dryer section;

a guide roll for rotatably supporting said transfer fabric such that said guide roll guides the web between said transfer fabric and said dryer fabric; and said lead-in roll and said guide roll extending substantially within the press section so that the distance travelled by the web between the press section and the dryer section is minimized thereby minimizing the distance travelled by the unsupported web.

* * * * *